US010804650B2

(12) United States Patent
Lee et al.

(10) Patent No.: US 10,804,650 B2
(45) Date of Patent: Oct. 13, 2020

(54) ELECTRICAL CONNECTOR HAVING OFFSET CONTACTS FOR MINIMIZING OR CANCELLING CROSSTALK

(71) Applicant: Intel Corporation, Santa Clara, CA (US)

(72) Inventors: Jeffrey Lee, Chandler, AZ (US); Brent R. Rothermel, Pottstown, PA (US); Kemal Aygun, Chandler, AZ (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 16/468,271

(22) PCT Filed: Dec. 31, 2016

(86) PCT No.: PCT/US2016/069650
§ 371 (c)(1),
(2) Date: Jun. 10, 2019

(87) PCT Pub. No.: WO2018/125259
PCT Pub. Date: Jul. 5, 2018

(65) Prior Publication Data

US 2020/0083645 A1 Mar. 12, 2020

(51) Int. Cl.
*H01R 12/00* (2006.01)
*H01R 13/6471* (2011.01)
(Continued)

(52) U.S. Cl.
CPC ..... *H01R 13/6471* (2013.01); *H01R 13/6587* (2013.01); *H01R 43/205* (2013.01)

(58) Field of Classification Search
CPC ..... H01R 13/6471; H01R 13/6587; H01R 43/205; H01R 43/20
(Continued)

(56) References Cited

U.S. PATENT DOCUMENTS 9,099,813 B1 8/2015 Trout et al.
2003/0171010 A1* 9/2003 Winings ..... H01R 13/6471 439/55
(Continued)

FOREIGN PATENT DOCUMENTS

WO WO 03/043138 A1 5/2003

OTHER PUBLICATIONS

PCT Application No. PCT/US2016/069650 Filing Date Dec. 31, 2016, Jeffrey Lee International Search Report dated Sep. 28, 2017, 16 Pages.
(Continued)

*Primary Examiner* — Abdullah A Riyami
*Assistant Examiner* — Nelson R. Burgos-Guntin
(74) *Attorney, Agent, or Firm* — Schwabe, Williamson & Wyatt, P.C.

(57) ABSTRACT

Electrical connector technology is disclosed. In one example, a connector for coupling an electronics sub-assembly to an electronics assembly comprises a connector body having and a sub-assembly interface configured to electrically couple to an electronics sub-assembly. The connector has a circuit board interface configured to electrically couple to a circuit board of an electronics assembly. The connector has at least two rows of contacts configured to electrically couple the circuit board to the electronics sub-assembly. The at least two rows of contacts are aligned offset relative to each other such that any ground contact of one row avoids intersection of a plane in which any ground contact of the other row resides to at least partially cancel row-to-row crosstalk when the at least two rows of contacts are transmitting signals at a predetermined high-speed bit rate.

24 Claims, 4 Drawing Sheets

(51) Int. Cl.
*H01R 13/6587* (2011.01)
*H01R 43/20* (2006.01)

(58) Field of Classification Search
USPC ..... 439/78, 941, 631, 92
See application file for complete search history.

(56) References Cited

U.S. PATENT DOCUMENTS

| | | | | |
|---|---|---|---|---|
| 2009/0298304 | A1* | 12/2009 | Brunker | H01R 12/732 439/61 |
| 2011/0269346 | A1 | 11/2011 | Casher et al. | |
| 2013/0288534 | A1 | 10/2013 | Degner | |
| 2018/0287280 | A1* | 10/2018 | Ratkovic | H01R 12/596 |
| 2019/0036263 | A1* | 1/2019 | Avery | H01R 13/631 |
| 2019/0044286 | A1* | 2/2019 | Moon | H01R 13/652 |
| 2019/0097357 | A1* | 3/2019 | Mongold | H01R 13/514 |
| 2019/0363050 | A1* | 11/2019 | Kariyazaki | H04L 25/0298 |
| 2020/0083645 | A1* | 3/2020 | Lee | H01R 43/20 |
| 2020/0112128 | A1* | 4/2020 | Liu | H01R 13/502 |

OTHER PUBLICATIONS

PCT Application No. PCT/US2016/069650 Filing Date Dec. 31, 2016, Jeffrey Lee International Search Report dated Sep. 1, 2018, 16 Pages.

* cited by examiner

ELECTRICAL CONNECTOR HAVING OFFSET CONTACTS FOR MINIMIZING OR CANCELLING CROSSTALK

PRIORITY INFORMATION

This application is a 371 U.S. national stage entry of PCT Application Serial No. PCT/US2016/069650, filed Dec. 31, 2016, which is incorporated herein by reference in its entirety.

TECHNICAL FIELD

Embodiments described herein relate generally to electrical connectors.

BACKGROUND

Electrically induced crosstalk imparted by electrical connectors between electronic devices can be a severe problem that affects signaling, particularly with high-speed bit rate applications. With edge connectors, the metal contacts are typically elongated pins, in order to meet mechanical integrity requirements for substrate mating to the connector. However, ground contacts designed in this manner are not sufficiently grounded near their midpoints and are susceptible to signal-to-ground noise coupling, which can further propagate into other nearby, adjacent signal contacts. This is particularly problematic when an electrical connector is transmitting signals at a high-speed bit rate (e.g., 25 or 50+ Gbps), which results in significant and problematic row-to-row crosstalk noise. This can dramatically interfere with the signals being transmitted. This is particularly prevalent when substrates (of electrical devices) that are coupled by the connector are very thin, such as 1.0-1.2 millimeters.

BRIEF DESCRIPTION OF THE DRAWINGS

Various features and advantages will be apparent from the detailed description which follows, taken in conjunction with the accompanying drawings, which together illustrate, by way of example, various invention embodiments; and, wherein.

DESCRIPTION OF EMBODIMENTS

Figure 1:
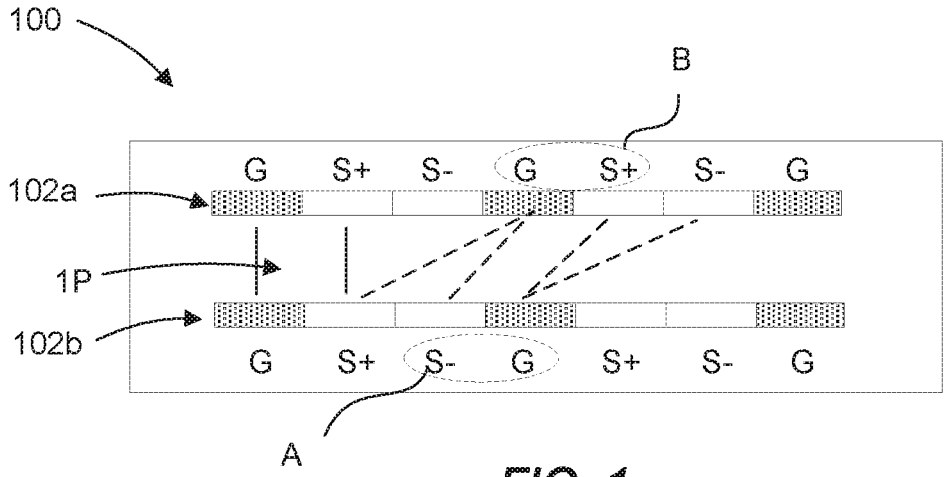
FIG. 1 illustrates a schematic front plan view of a typical electrical connector.

Before invention embodiments are disclosed and described, it is to be understood that no limitation to the particular structures, process steps, or materials disclosed herein is intended, but also includes equivalents thereof as would be recognized by those ordinarily skilled in the relevant arts. It should also be understood that terminology employed herein is used for the purpose of describing particular examples only and is not intended to be limiting. The same reference numerals in different drawings represent the same element. Numbers provided in flow charts and processes are provided for clarity in illustrating steps and operations and do not necessarily indicate a particular order or sequence. Unless defined otherwise, all technical and scientific terms used herein have the same meaning as commonly understood by one of ordinary skill in the art to which this disclosure belongs.

As used in this written description, the singular forms "a," "an" and "the" include express support for plural referents unless the context clearly dictates otherwise. Thus, for example, reference to "a layer" includes a plurality of such layers.

In this disclosure, "comprises," "comprising," "containing" and "having" and the like can have the meaning ascribed to them in U.S. patent law and can mean "includes," "including," and the like, and are generally interpreted to be open ended terms. The terms "consisting of" or "consists of" are closed terms, and include only the components, structures, steps, or the like specifically listed in conjunction with such terms, as well as that which is in accordance with U.S. patent law. "Consisting essentially of" or "consists essentially of" have the meaning generally ascribed to them by U.S. patent law. In particular, such terms are generally closed terms, with the exception of allowing inclusion of additional items, materials, components, steps, or elements, that do not materially affect the basic and novel characteristics or function of the item(s) used in connection therewith. For example, trace elements present in a composition, but not affecting the composition's nature or characteristics would be permissible if present under the "consisting essentially of" language, even though not expressly recited in a list of items following such terminology. When using an open ended term in the written description, like "comprising" or "including," it is understood that direct support should be afforded also to "consisting essentially of" language as well as "consisting of" language as if stated explicitly and vice versa.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Similarly, if a method is described herein as comprising a series of steps, the order of such steps as presented herein is not necessarily the only order in which such steps may be performed, and certain of the stated steps may possibly be omitted and/or certain other steps not described herein may possibly be added to the method.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments described herein are, for example, capable of operation in other orientations than those illustrated or otherwise described herein. The term "coupled," as used herein, is defined as directly or indirectly connected in an electrical or nonelectrical manner. Objects described herein as being "adjacent to" each other may be in physical contact with each other, in close proximity to each other, or in the same general region or area as each other, as appropriate for the context in which the phrase is used.

Occurrences of the phrase "in one embodiment," or "in one aspect," herein do not necessarily all refer to the same embodiment or aspect.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. For example, a composition that is "substantially free of" particles would either completely lack particles, or so nearly completely lack particles that the effect would be the same as if it completely lacked particles. In other words, a composition that is "substantially free of" an ingredient or element may still actually contain such item as long as there is no measurable effect thereof.

As used herein, the term "about" is used to provide flexibility to a numerical range endpoint by providing that a given value may be "a little above" or "a little below" the endpoint.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, sizes, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually.

This same principle applies to ranges reciting only one numerical value as a minimum or a maximum. Furthermore, such an interpretation should apply regardless of the breadth of the range or the characteristics being described.

Reference throughout this specification to "an example" means that a particular feature, structure, or characteristic described in connection with the example is included in at least one embodiment. Thus, appearances of the phrases "in an example" in various places throughout this specification are not necessarily all referring to the same embodiment.

Furthermore, the described features, structures, or characteristics may be combined in any suitable manner in one or more embodiments. In this description, numerous specific details are provided, such as examples of layouts, distances, network examples, etc. One skilled in the relevant art will recognize, however, that many variations are possible without one or more of the specific details, or with other methods, components, layouts, measurements, etc. In other instances, well-known structures, materials, or operations are not shown or described in detail but are considered well within the scope of the disclosure.

As used herein, the term "high-speed" means a bit rate of at least 25 Gbps, and in some examples, means a bit rate of at least 50 Gbps.

Example Embodiments

An initial overview of technology embodiments is provided below and specific technology embodiments are then described in further detail. This initial summary is intended to aid readers in understanding the technology more quickly, but is not intended to identify key or essential features of the technology nor is it intended to limit the scope of the claimed subject matter.

In one embodiment, an electrical connector is disclosed for coupling an electronics sub-assembly to an electronics assembly. The connector can comprise a connector body having a sub-assembly interface configured to electrically couple to an electronics sub-assembly and a circuit board interface configured to electrically couple to a circuit board of an electronics assembly. The connector body can comprise at least two rows of contacts configured to electrically couple the circuit board to the electronics sub-assembly. The at least two rows of contacts are aligned offset relative to each other such that any ground contact of one row avoids vertical intersection with any ground contact of the other row to at least partially cancel or otherwise avoid row-to-row crosstalk when the at least two rows of contacts are transmitting signals at a predetermined high-speed bit rate.

FIG. 1 illustrates a schematic of a typical electrical connector 100 for electrically coupling one electronics device to another electronics device. In general, the electrical connector 100 includes a first row 102*a* and a second row 102*b*, each having a plurality of contacts in a row. Each row 102*a* and 102*b* has a plurality of ground contacts (labeled "G"). Each row 102*a* and 102*b* further has a plurality of pairs of signaling contacts (labeled "S+" and "S−", indicating positive and negative polarities). This pattern continues throughout each row in a typical manner. Of course, each contact defines a "pitch" (i.e., the distance from the center of one contact to the center of the next), as exemplified by gap 1P labeled on FIG. 1 (and other figures).

In applications where the connector 100 is an edge connector, the contacts are elongated pins in order to meet mechanical integrity requirements for substrate mating to the connector. However, ground contacts designed in this manner are not sufficiently grounded near their midpoints and are susceptible to signal-to-ground noise coupling, which can further propagate into other nearby, adjacent signals. This is particularly problematic when the electrical connector 100 is transmitting signals at a high-speed bit rate (e.g., 25+ or 50+ Gbps), which results in significant and problematic row-to-row crosstalk noise. This can dramatically interfere with the signals being transmitted. This is particularly prevalent when substrates coupled to the connector 100 are very thin, such as 1.0-1.2 millimeters, or even less. For example, ground-injected noise is asymmetrically distributed across a distance between opposing signal contacts and an opposing ground contact, as indicated by the dashed lines on FIG. 1 extending between the rows. More specifically, an aggressor pair A (S− and G on row 102*b*) inductively causes row-to-row noise to opposing victim pair B (G and S+ on row 102*a*). That is, the victim S+ receives more noise than S−, resulting in non-zero differential (S+ minus S−) crosstalk noise. This crosstalk continues along contacts of the rows 102*a* and 102*b*, which can significantly impact signaling of electronic devices transmitting high-speed bit rates via the connector, such as with non-return-to-zero (NRZ), phase-shift keying (PSK), Quadrature amplitude modulation (QAM), and pulse amplitude modulation (PAM) signaling.

Figure 2A:
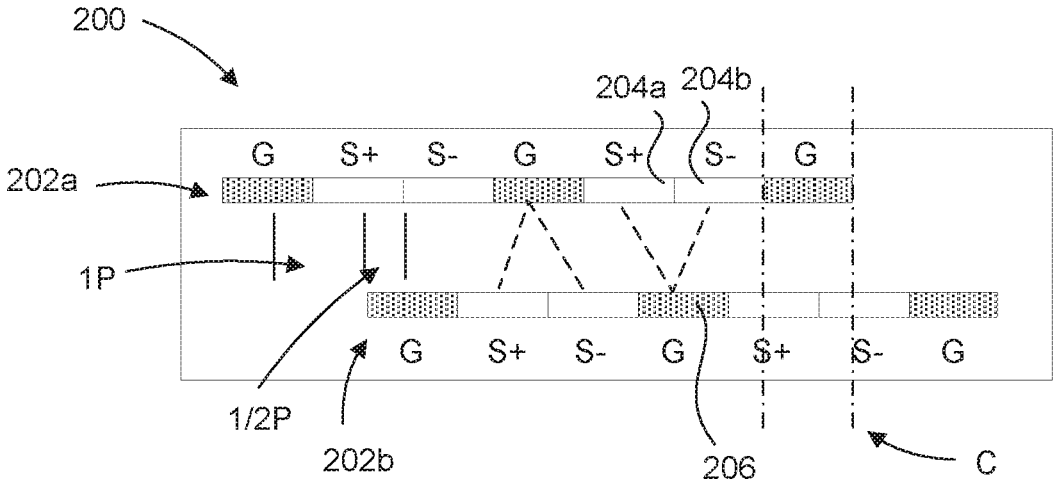
FIG. 2A illustrates a schematic front plan view of an electrical connector in accordance with an example invention embodiment.
Figure 4:
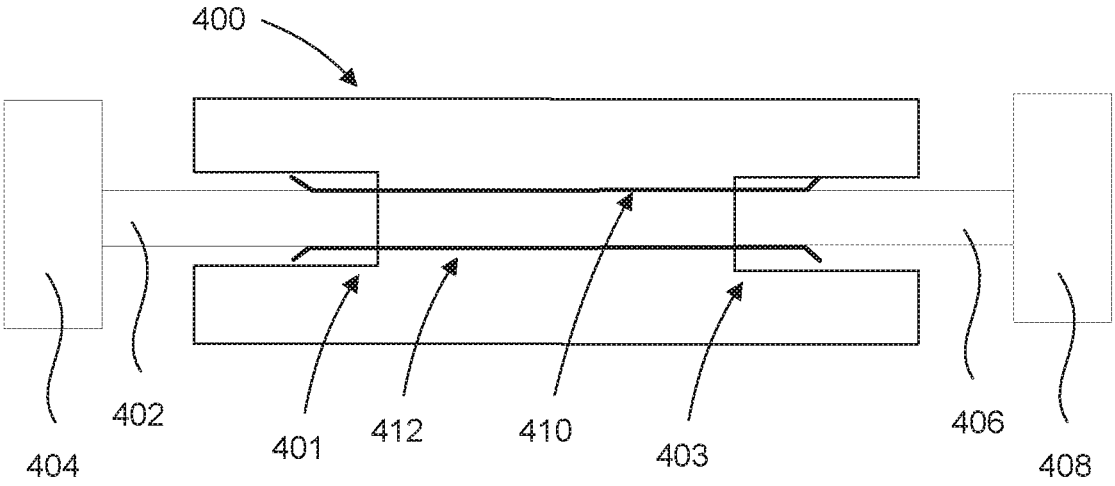
FIG. 4 illustrates a schematic side plan view of an electrical connector in accordance with an example invention embodiment.

FIG. 2A illustrates a schematic of an electrical connector 200 for electrically coupling one electronics device to another electronics device, such as an electronics sub-assembly to an electronics assembly (e.g., FIG. 4). The connector 200 can be an edge connector coupled to a sub-assembly (e.g., a high-performance computing device fabric platform). In general, the electrical connector 200 includes a first row 202*a* and a second row 202*b*, each having a plurality of pairs of signal contacts (only one pair labeled specifically as 204*a* and 204*b*). Each row 202*a* and 202*b* has a plurality of ground contacts (only one labeled specifically as 206). Each row 202*a* and 202*b* further has a plurality of pairs of signaling contacts (as indicated by respective symbols). Each of the pairs of signal contacts has respective positive and negative polarity (as indicated by the associated symbols). This pattern continues throughout each row.

Figure 2B:
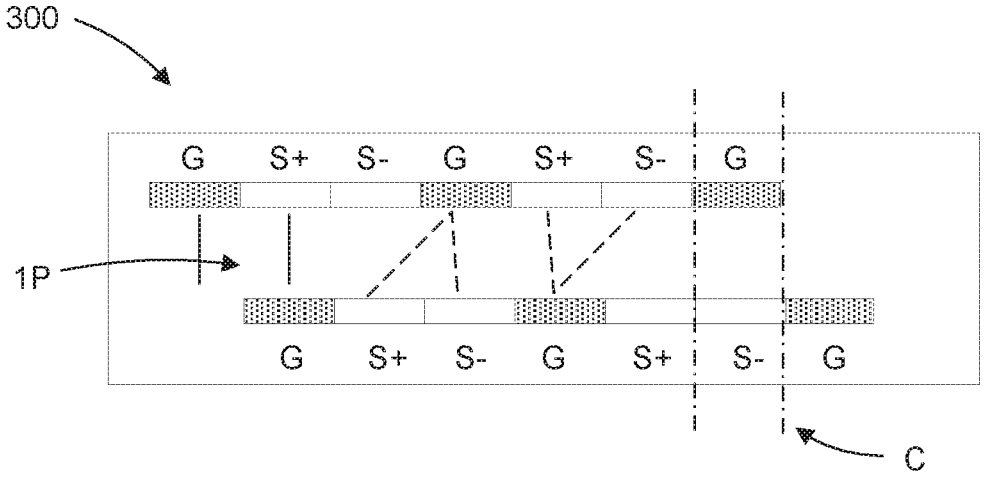
FIG. 2B illustrates a schematic front plan view of an electrical connector in accordance with an example invention embodiment.

Notably, the second row 202*b* is aligned offset relative to the first row 202*a* such that any ground contact G of the second row 202*b* avoids vertical intersection with any ground contact of the first row 202*a* (e.g. intersection with a plane in which any ground contact of row 202*a* resides). This "vertical intersection" configuration is illustrated by dashed lines C on both FIGS. 2A and 2B, showing that any ground contact of one row does not vertically intersect any opposing ground contact (e.g. a plane thereof) on another row. Said another way, a pitch of a particular ground contact vertically intersects with one opposing signal contact (e.g., FIG. 2B shows the pitch of any ground contact G vertically intersecting between a width of an opposing signal contact S−). As discussed further below, such configuration of FIGS. 2A and 2B minimizes or substantially (or entirely) cancels row-to-row crosstalk.

Figure 3:
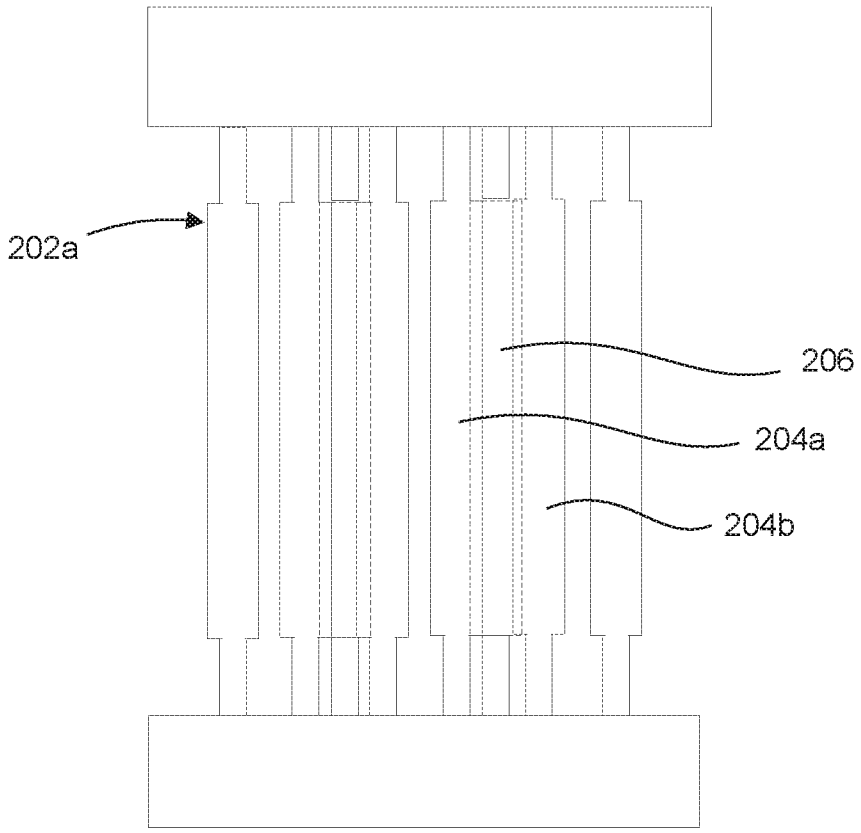
FIG. 3 illustrates a schematic top plan view of contacts of the electrical connector of FIG. 2A in accordance with an example invention embodiment.

In a preferred example shown on FIG. 2A, the rows 202*a* and 202*b* are offset relative to each other by 1 and ½ Pitch, as indicated by the arrows 1P and ½P. Thus, each ground contact (e.g., 206) of one row (e.g., 202*b*) is substantially centered between a pair of differential signal contacts (e.g., 204*a* and 204*b*) of the other row (e.g., 202*a*). This is also illustrated on FIG. 3, showing a schematic top view of some of the contacts of FIG. 2A. As such, the (lower) ground contact 206 is centered about the (upper) pair of signaling contacts 212*a* and 212*b*. In this manner, a pair of differential signal contacts (e.g., signal contact 204*a* having a positive polarity, and adjacent signal contact 204*b* having a negative polarity) are arranged such that the ground contact 206 on the opposing row 202*b* results in a zero-sum noise scheme among said pair of adjacent signal contacts 204*a* and 204*b*. The fact that ground contact 206 is positioned equidistance to both signal contacts 204*a* and 204*b* contributes to this result. This scheme continues along respective grounds and signal contacts along the rows 202*a* and 202*b*. The "zero-sum" noise results from this configuration because the injected noise polarities sum to zero on the opposite-row ground contact (i.e., no further propagation to an adjacent victim signal contact). Differential signal pairs inherently reject common mode noise, thereby suppressing noise injected in this manner. Likewise, any row-to-row noise injected by a signal pair into the nearest facing ground contact will zero-sum because of the symmetrical arrangement (i.e., aforementioned equidistance) of opposing signal polarities about the ground victim. This halts any further ground-to-signal noise propagation along the victim row.

In the example shown in FIG. 2B, the rows (upper and lower) are offset by 1 Pitch relative to each other, as indicated by the reference arrow 1P. In this configuration, a crosstalk noise reduction is achieved, but to a degree less as compared to the configuration of FIG. 2A where the particular ground contact is equidistance (e.g. 1.5 Pitch) to opposing signal contacts (as illustrated by the dashed lines between the contacts). However, as illustrated by the vertical intersection lines C, in the configuration of FIG. 2B, any ground contact of one row avoids vertical intersection of an opposing ground contact, and therefore, a crosstalk noise reduction is achieved.

In applications requiring higher I/O pin density, the two-row connector may be expanded into a four-row double-decker configuration, with a pair of upper rows and a pair of lower rows (i.e., on either side of a receiving substrate); these rows can be positioned offset relative to each other (and even relative to each row within a pair of rows). This can also cancel crosstalk in a similar manner as in FIGS. 2A and 2B.

FIG. 4 illustrates a schematic of a connector 400 electrically coupling a substrate 402 of an electronics sub-assembly 404 and a substrate 406 of an electronics assembly 408. The connector 400 can have a sub-assembly interface 401 configured to electrically couple to the electronics sub-assembly 404 (e.g., via the substrate 402). The connector 400 can have a circuit board interface 403 configured to electrically couple to a circuit board (e.g., substrate 406) of the electronics assembly 408. A first row of contacts 410 and a second row of contacts 412 (extending between interfaces 401 and 403) electrically couple upper and lower contacts on each of the substrates 406 and 408, respectively. The first and second rows of contacts 410 and 412 are off-set relative to each other, such as described with reference to FIGS. 2A, 2B, and 3. In some examples, either or both substrates 402 and 406 have a thickness of 1.0-1.2 millimeters. In other examples, the thickness can be less than 1.0 millimeters. In one example, the connector 400 is formed with a sub-assembly, such as an edge connector of a high-performance computing device or other platform that is interfaceable to a circuit board of a computing system. A plurality of such connectors 400 can be used in a particular sub-assembly and/or assembly.

The connectors described herein can be manufactured in a number of particular manners. For example, the connector can be a single dielectric body that is co-injection molded with an upper row and a lower row of electrical contacts therein. A front housing and back shell can be coupled to the co-injected body thereafter, or can be formed during the molding process. In a preferred example, the upper and lower contacts can first be stamped (e.g., as elongated pin contacts). These contacts can be inserted into respective upper or lower dielectric mold housings, and while the cablings are being prepped for electrical connection with the contacts. Once each of the upper and lower assemblies are manufactured (i.e., the contacts/cabling in each of the upper and lower housings), the upper assembly can be snapped (or otherwise attached) to the lower assembly. Thereafter, this combined assembly can be stitched into the housings. Then, a front housing can be attached thereto, and a back shell can be attached thereto to complete the formation of a high-speed connector, in one example.

Figure 5:
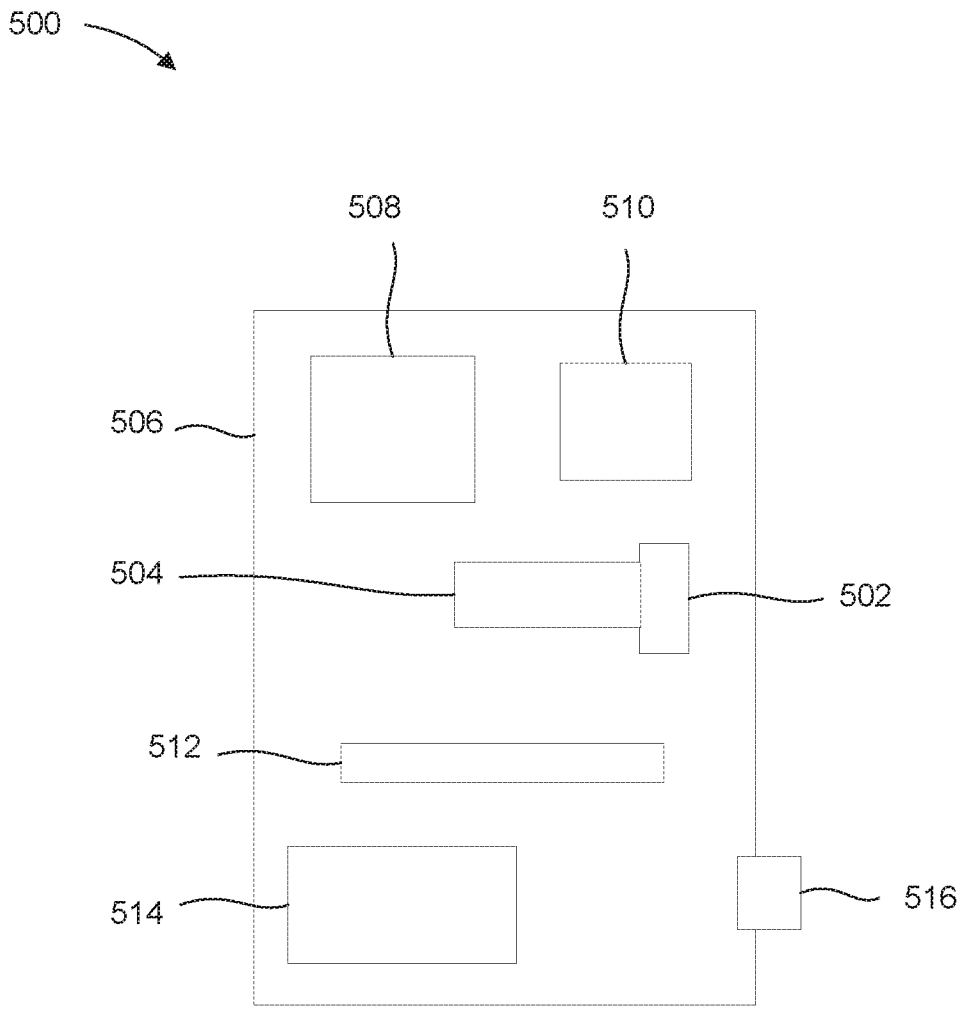
FIG. 5 illustrates a plan view of a system having an electrical connector in accordance with an example invention embodiment.

FIG. 5 illustrates an example computing system 500. The computing system 500 can include a connector 502 coupling an electronics sub-assembly 504 to an electronics assembly such as a motherboard 506. In one aspect, the computing system 500 can also include a processor 508, a memory device 510, a radio 512, a heat sink 514, a port 516, a slot, or any other suitable device or component, which can be operably coupled to the motherboard 506. The computing system 500 can comprise any type of computing system, such as a desktop computer, a laptop computer, a tablet computer, a smartphone, a server, etc.

Figure 6:
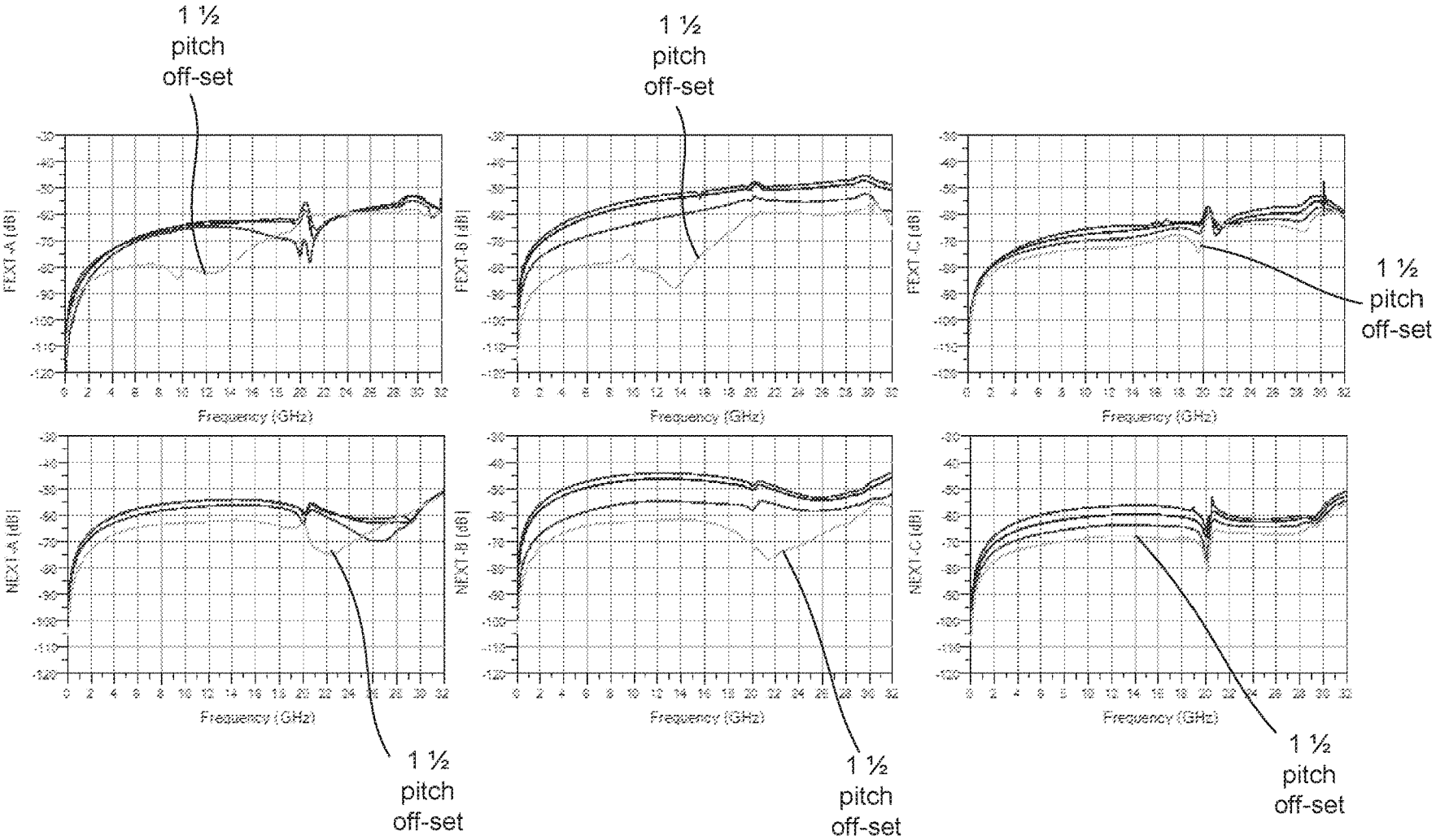
FIG. 6 illustrates graphs showing the crosstalk cancellation performance of a 1½ pitch offset connector compared to other connectors in accordance with an example invention embodiment.

FIG. 6 shows various graphs illustrating the cross-talk cancellation performance results of four different connectors (i.e., no pitch offset, ½ pitch offset, 1 pitch offset, and 1½ pitch offset). The x-axes are Frequency (GHz) and the y-axes are FEXT (A,B,C) (dB) (upper graphs) and NEXT (A,B,C) (dB) (lower graphs), as known in the industry for measuring far-end cross talk and near-end crosstalk, respectively. The "A" "B" and "C" referenced graphs pertain to pairs of aggressor signal contacts (along a row) as inducing crosstalk to an opposing signal pair of victim contacts (on an opposing row). That is, A corresponds to the left two graphs, B corresponds to the middle two graphs, and C corresponds to the right two graphs. As labeled, the 1½ pitch offset connector configuration performs better (i.e., at reducing crosstalk) than connectors having no offset pitch, ½ pitch offset, and 1 pitch offset. For illustration clarity, only the performance of the 1½ pitch offset connector is labeled on the six graphs. While the various types of pitch offsets ranging from a ½P to 1½ P (i.e. 1.5P) may achieve various amounts of crosstalk reduction, it will be appreciated that any amount of reduction achieved as compared to a typical 0P offset (e.g. no offset) is within the scope of the present disclosure. Specific configurations and amounts or degrees of offset can be selected in conjunction with other features or designs to achieve or arrive at a component or device that provides a specifically desired result or overall performance characteristic.

Circuitry used in electronic components or devices (e.g. a die) of an electronic device package can include hardware, firmware, program code, executable code, computer instructions, and/or software. Electronic components and devices can include a non-transitory computer readable storage medium which can be a computer readable storage medium that does not include signal. In the case of program code execution on programmable computers, the computing devices recited herein may include a processor, a storage medium readable by the processor (including volatile and non-volatile memory and/or storage elements), at least one input device, and at least one output device. Volatile and non-volatile memory and/or storage elements may be a RAM, EPROM, flash drive, optical drive, magnetic hard drive, solid state drive, or other medium for storing electronic data. Node and wireless devices may also include a transceiver module, a counter module, a processing module, and/or a clock module or timer module. One or more programs that may implement or utilize any techniques described herein may use an application programming interface (API), reusable controls, and the like. Such programs may be implemented in a high level procedural or object oriented programming language to communicate with a computer system. However, the program(s) may be implemented in assembly or machine language, if desired. In any case, the language may be a compiled or interpreted language, and combined with hardware implementations.

Examples

The following examples pertain to further embodiments.

In one example there is provided an electrical connector for coupling an electronics sub-assembly to an electronics assembly. The connector can comprise a connector body having a sub-assembly interface configured to electrically couple to an electronics sub-assembly and a circuit board interface configured to electrically couple to a circuit board of an electronics assembly. The connector body can comprise at least two rows of contacts configured to electrically couple the circuit board to the electronics sub-assembly. The at least two rows of contacts are aligned offset relative to each other such that any ground contact of one row avoids intersection with a plane in which any ground contact of the other row resides. Such an arrangement can at least partially cancel row-to-row crosstalk when the at least two rows of contacts are transmitting signals at a predetermined high-speed bit rate.

In one example, each ground contact of one row is substantially centered between a pair of differential signal contacts of the other row.

In one example, said pair of differential signal contacts comprises a negative polarity contact and an adjacent positive polarity contact such that a ground contact on an opposing row facilitates a zero-sum noise scheme among said pair of adjacent signal contacts.

In one example, any ground contact of one row is positioned equidistance from each signal contact of said pair of differential signal contacts of the other row such that ground noise is substantially evenly distributed across said pair of differential signal contacts.

In one example, the contacts of one row are offset by at least one pitch relative to the contacts of the other row.

In one example, the contacts of one row are offset by approximately one and one half pitch relative to the contacts of the other row.

In one example, the rows of contacts are separated by at least 1.5 millimeters.

In one example, the rows of contacts are separated by at least 1.0 millimeters.

In one example, the rows of contacts are separated by a distance between 0.50 and 1.0 millimeters.

In one example, the at least two rows of contacts are aligned relative to each other such that any ground contact of one row is vertically aligned with at least one signal contact of a pair of differential signal contacts of the other row.

In one example, the connector is configured to optimize signal modulation for at least one of non-return-to-zero (NRZ), phase-shift keying (PSK), Quadrature amplitude modulation (QAM), and pulse amplitude modulation (PAM) signaling.

In one example, the high-speed connector is configured to at least partially cancel row-to-row ground noise crosstalk.

In one example, the predetermined high-speed bit rate is at least 25 Gbps per-lane speed.

In one example, the predetermined high-speed bit rate is at least 50 Gbps per-lane speed.

In one example, each contact of the at least two rows of contacts comprises an elongated pin contact.

In one example, the connector body comprises an upper housing and a lower housing coupled together, wherein the upper housing supports a first row of contacts of the at least two rows of contacts, and the lower housing supports a second row of contacts of the at least two rows of contacts.

In one example, the connector body comprises a front housing and a back shell each coupled to the upper and lower housings.

In one example there is provided an electronics assembly comprising an assembly circuit board electrically coupleable to a computer system, and a high-speed connector as recited herein.

In one example there is provided an electronics sub-assembly electrically coupleable to an electronics assembly. The electronics sub-assembly comprises a substrate and at least one computing component supported about the substrate. A connector has at least two rows of contacts and an electronics assembly interface configured to electrically couple the at least one computing component to an electronics assembly via said at least two rows of contacts. Said at least two rows of contacts can be aligned offset relative to each other such that any ground contact of one row avoids intersection with a plane in which any ground contact of the other row resides to at least partially cancel row-to-row crosstalk when the at least two rows of contacts are transmitting signals between the electronics sub-assembly and the electronics assembly at a predetermined high-speed bit rate.

In one example, each ground contact of one row is substantially centered between a pair of differential signal contacts of the other row.

In one example, said pair of differential signal contacts comprises a negative polarity contact and an adjacent positive polarity contact such that a ground contact on an opposing row facilitates a zero-sum noise scheme among said pair of adjacent signal contacts.

In one example, any ground contact of one row is positioned equidistance from each signal contact of said pair of differential signal contacts of the other row such that ground noise is substantially evenly distributed across said pair of differential signal contacts.

In one example, the contacts of one row are offset by at least one pitch relative to the contacts of the other row.

In one example, the contacts of one row are offset by approximately one and one half pitch relative to the contacts of the other row.

In one example, the rows of contacts are separated by at least 1.5 millimeters.

In one example, the rows of contacts are separated by at least 1.0 millimeters.

In one example, the rows of contacts are separated by a distance between 0.50 and 1.0 millimeters.

In one example, the at least two rows of contacts are aligned relative to each other such that any ground contact of one row is vertically aligned with at least one signal contact of a pair of differential signal contacts of the other row.

In one example, the electronics sub-assembly is configured to optimize signal modulation for at least one of non-return-to-zero (NRZ), phase-shift keying (PSK), Quadrature amplitude modulation (QAM), and pulse amplitude modulation (PAM) signaling.

In one example, the connector is configured to at least partially cancel row-to-row ground noise crosstalk.

In one example, the predetermined high-speed bit rate is at least 25 Gbps per-lane speed.

In one example, the predetermined high-speed bit rate is at least 50 Gbps per-lane speed.

In one example, the at least one computing component forms part of a high-performance computing device capable of processing at least 50 Gbps.

In one example, the connector comprises an upper housing and a lower housing coupled together, wherein the upper housing supports a first row of contacts of the at least two rows of contacts, and the lower housing supports a second row of contacts of the at least two rows of contacts.

In one example, the connector comprises a front housing and a back shell each coupled to the upper and lower housings.

In one example there is provided an electronics system having a connector configured to minimize crosstalk. The system can comprise an electronics assembly having an assembly circuit board and an electronics sub-assembly having at least one computing device, and a connector electrically coupling the assembly circuit board to the at least one computing device of the electronics sub-assembly. The connector can have at least two rows of contacts aligned offset relative to each other such that any ground contact of one row avoids intersection of a plane in which any ground contact of the other row resides to at least partially cancel row-to-row crosstalk when the at least two rows of contacts are transmitting signals between the electronics sub-assembly and the electronics assembly at a predetermined high-speed bit rate.

In one example, the each ground contact of one row is substantially centered between a pair of differential signal contacts of the other row.

In one example, said pair of differential signal contacts comprises a negative polarity contact and an adjacent positive polarity contact such that a ground contact on an opposing row facilitates a zero-sum noise scheme among said pair of adjacent signal contacts.

In one example, any ground contact of one row is positioned equidistance from each signal contact of said pair of differential signal contacts of the other row such that ground noise is substantially evenly distributed across said pair of differential signal contacts.

In one example, the contacts of one row are offset by at least one pitch relative to the contacts of the other row.

In one example, the contacts of one row are offset by approximately one and one half pitch relative to the contacts of the other row.

In one example, the electronics sub-assembly is configured to optimize signal modulation for at least one of non-return-to-zero (NRZ), phase-shift keying (PSK), Quadrature amplitude modulation (QAM), and pulse amplitude modulation (PAM) signaling.

In one example, the predetermined high-speed bit rate is at least 50 Gbps per-lane speed.

In one example there is provided a method of making a connector for coupling an electronics assembly to an electronics sub-assembly. The method can comprise forming a connector body having: a sub-assembly interface configured to electrically couple to an electronics sub-assembly; a circuit board interface configured to electrically couple to a circuit board of an electronics assembly; and at least two rows of contacts configured to electrically couple the circuit board to the electronics sub-assembly. The at least two rows of contacts are aligned offset relative to each other such that any ground contact of one row avoids intersection with a plane in which any ground contact of the other row resides to at least partially cancel row-to-row crosstalk when the at least two rows of contacts are transmitting signals at a predetermined high-speed bit rate.

In one example, the method includes arranging each ground contact of one row substantially centered between a pair of differential signal contacts of the other row.

In one example of the method, the pair of differential signal contacts comprises a negative polarity contact and an adjacent positive polarity contact such that a ground contact on an opposing row facilitates a zero-sum noise scheme among said pair of adjacent signal contacts.

In one example of the method, any ground contact of one row is positioned equidistance from each signal contact of said pair of differential signal contacts of the other row such that ground noise is substantially evenly distributed across said pair of differential signal contacts.

In one example of the method, the contacts of one row are offset by approximately one and one half pitch relative to the contacts of the other row.

In one example of the method, the rows of contacts are separated by a distance between 0.50 and 1.2 millimeters.

In one example, the method comprises attaching an upper housing to a lower housing to form the connector body, wherein the upper housing supports a first row of contacts of the at least two rows of contacts, and the lower housing supports a second row of contacts of the at least two rows of contacts.

In one example, the method comprises attaching a front housing and a back shell to the upper and lower housings.

In one example there is provided a method of coupling an electronics sub-assembly to an electronics assembly via a high-speed connector. The method can comprise providing an assembly circuit board electrically coupleable to a computer system; providing an electronics sub-assembly having at least one computing device and a high-speed connector; and electrically coupling the high-speed connector to the assembly circuit board. The high-speed connector comprises at least two rows of contacts aligned offset relative to each other such that any ground contact of one row avoids intersection with a plane in which any ground contact of the other row resides to at least partially cancel row-to-row crosstalk when the at least two rows of contacts are transmitting signals at a predetermined high-speed bit rate.

In one example, the method comprises arranging each ground contact of one row substantially centered between a pair of differential signal contacts of the other row.

In one example of the method, said pair of differential signal contacts comprises a negative polarity contact and an adjacent positive polarity contact such that a ground contact on an opposing row facilitates a zero-sum noise scheme among said pair of adjacent signal contacts.

In one example of the method, any ground contact of one row is positioned equidistance from each signal contact of said pair of differential signal contacts of the other row such that ground noise is substantially evenly distributed across said pair of differential signal contacts.

In one example of the method, the contacts of one row are offset by approximately one and one half pitch relative to the contacts of the other row.

While the forgoing examples are illustrative of the specific embodiments in one or more particular applications, it will be apparent to those of ordinary skill in the art that numerous modifications in form, usage and details of implementation can be made without departing from the principles and concepts articulated herein.

What is claimed is:

1. A high-speed connector for coupling an electronics sub-assembly to an electronics assembly, the connector comprising:

a connector body having:

a sub-assembly interface configured to electrically couple to an electronics sub-assembly;

a circuit board interface configured to electrically couple to a circuit board of an electronics assembly; and at least two rows of contacts configured to electrically couple the circuit board to the electronics sub-assembly, the at least two rows of contacts aligned off-set relative to each other such that any ground contact of one row avoids vertical intersection with any ground contact of the other row to at least partially cancel row-to-row crosstalk when the at least two rows of contacts are transmitting signals at a predetermined high-speed bit rate, wherein the each ground contact of one row is substantially centered between a pair of differential signal contacts of the other row.

2. The high-speed connector of claim 1, wherein said pair of differential signal contacts comprises a negative polarity contact and an adjacent positive polarity contact such that a ground contact on an opposing row facilitates a zero-sum noise scheme among said pair of adjacent signal contacts.

3. The high-speed connector of claim 1, wherein any ground contact of one row is positioned equidistance from each signal contact of said pair of differential signal contacts of the other row such that ground noise is substantially evenly distributed across said pair of differential signal contacts.

4. The high-speed connector of claim 1, wherein the contacts of one row are off-set by at least one pitch relative to the contacts of the other row.

5. The high-speed connector of claim 4, wherein the contacts of one row are off-set by approximately one and one half pitch relative to the contacts of the other row.

6. The high-speed connector of claim 1, wherein the rows of contacts are separated by at least 1.5 millimeters.

7. The high-speed connector of claim 1, wherein the rows of contacts are separated by at least 1.0 millimeters.

8. The high-speed connector of claim 1, wherein the rows of contacts are separated by a distance between 0.50 and 1.0 millimeters.

9. The high-speed connector of claim 1, wherein the at least two rows of contacts are aligned relative to each other such that any ground contact of one row is vertically aligned with at least one signal contact of a pair of differential signal contacts of the other row.

10. The high-speed connector of claim 1, wherein the connector is configured to optimize signal modulation for at least one of non-return-to-zero (NRZ), phase-shift keying (PSK), Quadrature amplitude modulation (QAM), and pulse amplitude modulation (PAM) signaling.

11. The high-speed connector of claim 10, wherein the high-speed connector is configured to at least partially cancel row-to-row ground noise crosstalk.

12. The high-speed connector of claim 1, wherein the predetermined high-speed bit rate is at least 25 Gbps per-lane speed.

13. The high-speed connector of claim 1, wherein the predetermined high-speed bit rate is at least 50 Gbps per-lane speed.

14. The high-speed connector of claim 1, wherein each contact of the at least two rows of contacts comprises an elongated pin contact.

15. The high-speed connector of claim 1, wherein the connector body comprises an upper housing and a lower housing coupled together, wherein the upper housing supports a first row of contacts of the at least two rows of contacts, and the lower housing supports a second row of contacts of the at least two rows of contacts.

16. The high-speed connector of claim 15, wherein the connector body comprises a front housing and a back shell each coupled to the upper and lower housings.

17. An electronics assembly comprising:

an assembly circuit board electrically coupleable to a computer system; and a high-speed connector as recited in claim 1 electrically coupled to the assembly circuit board.

18. A method of making a connector for coupling an electronics assembly to an electronics sub-assembly, the method comprising:

forming a connector body having:

a sub-assembly interface configured to electrically couple to an electronics sub-assembly;

a circuit board interface configured to electrically couple to a circuit board of an electronics assembly; and at least two rows of contacts configured to electrically couple the circuit board to the electronics sub-assembly, the at least two rows of contacts aligned off-set relative to each other such that any ground contact of one row avoids vertical intersection with any ground contact of the other row to at least partially cancel row-to-row crosstalk when the at least two rows of contacts are transmitting signals at a predetermined high-speed bit rate; and arranging each ground contact of one row substantially centered between a pair of differential signal contacts of the other row.

19. The method of claim 18, wherein said pair of differential signal contacts comprises a negative polarity contact and an adjacent positive polarity contact such that a ground contact on an opposing row facilitates a zero-sum noise scheme among said pair of adjacent signal contacts.

20. The method of claim 19, wherein any ground contact of one row is positioned equidistance from each signal contact of said pair of differential signal contacts of the other row such that ground noise is substantially evenly distributed across said pair of differential signal contacts.

21. The method of claim 18, wherein the contacts of one row are off-set by approximately one and one half pitch relative to the contacts of the other row.

22. The method of claim 18, wherein the rows of contacts are separated by a distance between 0.50 and 1.2 millimeters.

23. The method of claim 18, further comprising attaching an upper housing to a lower housing to form the connector body, wherein the upper housing supports a first row of contacts of the at least two rows of contacts, and the lower housing supports a second row of contacts of the at least two rows of contacts.

24. The method of claim 23, further comprising attaching a front housing and a back shell to the upper and lower housings.

* * * * *